US007293860B2

(12) United States Patent
Sekiguchi

(10) Patent No.: US 7,293,860 B2
(45) Date of Patent: Nov. 13, 2007

(54) DROPLET EJECTING HEAD

(75) Inventor: Yasuhiro Sekiguchi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 347 days.

(21) Appl. No.: 11/156,101

(22) Filed: Jun. 17, 2005

(65) Prior Publication Data

US 2005/0285910 A1 Dec. 29, 2005

(30) Foreign Application Priority Data

Jun. 17, 2004 (JP) ..... 2004-179529

(51) Int. Cl.

| | |
|---|---|
| ***B41J 2/15*** | (2006.01) |
| ***B41J 2/145*** | (2006.01) |
| ***B41J 2/21*** | (2006.01) |
| ***B41J 2/14*** | (2006.01) |
| ***B41J 2/16*** | (2006.01) |
| ***B41J 2/05*** | (2006.01) |
| ***B41J 2/045*** | (2006.01) |

(52) U.S. Cl. ..... 347/71; 347/40; 347/43; 347/47; 347/65

(58) Field of Classification Search ..... 347/40, 347/47, 71

See application file for complete search history.

(56) References Cited

U.S. PATENT DOCUMENTS

| | | | |
|---|---|---|---|
| 4,587,534 | A | 5/1986 | Saito et al. |
| 5,402,159 | A | 3/1995 | Takahashi et al. |
| 5,971,528 | A | 10/1999 | Yoshimura |
| 6,604,817 | B2 | 8/2003 | Isono et al. |

FOREIGN PATENT DOCUMENTS

| | | |
|---|---|---|
| JP | 59-138471 | 8/1984 |
| JP | 4-341853 | 11/1992 |
| JP | 6-246917 | 9/1994 |
| JP | 11147316 | 6/1999 |
| JP | 2001-246744 | 9/2001 |

*Primary Examiner*—Matthew Luu
*Assistant Examiner*—Lisa M Solomon
(74) *Attorney, Agent, or Firm*—Reed Smith LLP

(57) ABSTRACT

A droplet ejecting head including a nozzle plate having nozzle holes each ejecting a droplet and comprising: a jetting end open at a first surface of the plate; an inflow end open at a second surface of the plate; a taper portion between the jetting end and a vicinity of the inflow end, where a diameter of the nozzle hole linearly increases from the jetting end to the vicinity so as to have a taper angle; a connecting portion comprising a surface connecting the taper portion and the inflow end, at the connecting portion the diameter increasing more greatly than at the taper angle; and where D1 and D2 respectively represent the diameter of the nozzle hole at the inflow end and at an imaginary inflow end obtained if the taper portion extends at the taper angle up to the second surface, D2<D1<1.2×D2.

9 Claims, 6 Drawing Sheets

FIG.6

| D1(μm) | D2(μm) | D1/D2 | RESULT OF EVALUATION |
|---|---|---|---|
| 50.6 | 47.2 | 1.07 | ○ |
| 51.9 | 47.2 | 1.10 | ○ |
| 53.1 | 47.2 | 1.13 | ○ |
| 56.1 | 47.2 | 1.19 | ○ |
| 57.7 | 47.2 | 1.22 | × |

DROPLET EJECTING HEAD

The present application is based on Japanese Patent Application No. 2004-179529, filed on Jun. 17, 2004, the content of which is incorporated herein by reference.

BACKGROUND OF THE INVENTION

1. Field of the Invention

The present invention relates to a droplet ejecting head having a nozzle hole for ejecting a droplet of a liquid or the like therethrough. Such a droplet ejecting head may be an inkjet printhead, but not limited thereto. For instance, there are also a head which ejects droplets of a material having an electrical conductivity onto a substrate to form wiring or a circuit on the substrate, and a head which ejects droplets of a solidifiable material to form a three-dimensional shape which is then solidified to obtain a three-dimensional body.

2. Description of the Related Art

In such a kind of droplet ejecting head, the size and shape of the droplets are desired to be regulated with high accuracy and precision. This will be described more specifically by holding up the inkjet printhead as an example.

Disclosed in Japanese Patent Application Laid-Open No. 2001-246744, there is known an inkjet printhead comprising a cavity unit formed of a laminate of a plurality of plates including a nozzle plate, a piezoelectric actuator, and a flexible flat cable. The cavity unit has a nozzle surface as an external surface of the nozzle plate through which are formed a plurality of nozzle holes to be opposed to a recording medium, and a plurality of pressure chambers respectively corresponding to the nozzle holes. The piezoelectric actuator is superposed on a surface of the cavity unit opposite to the nozzle surface, so as to selectively pressurize the pressure chambers to eject an ink droplet from a nozzle hole corresponding to the pressurized pressure chamber. The flexible flat cable is for supplying electric signals therethrough to the piezoelectric actuator.

In such an inkjet printhead, the piezoelectric actuator selectively reduces the volume of the pressure chambers in accordance with the signals received through the flexible flat cable, so as to eject ink droplets through the nozzle holes onto the recording medium. Therefore, the shape of the nozzle holes considerably affects the ink ejection performance.

It is known that in order to ensure a good ink ejection performance, the nozzle hole is suitably formed in the shape such that a diameter of the nozzle hole is smaller on an ink jetting side, namely, at the nozzle surface, than on an ink inflow side, namely, at the surface of the nozzle plate opposite to the nozzle surface. That is, the nozzle hole is tapered or narrowed from the internal side toward the external, jetting side. For instance, Japanese Patent Application Laid-Open No. 6-246917 (see FIGS. 3 and 4) teaches to stabilize the ink ejection performance by configuring the nozzle hole to have an appropriate ratio of an area of its open end on the ink jetting side to an area of its open end on the ink inflow side, and an appropriate angle of the taper.

For instance, the nozzle holes having such a tapering shape may be formed by irradiation with a laser beam. More specifically, a plate material to be the nozzle plate is perforated with a laser beam, namely, the side of the plate material to be the surface opposite to the nozzle surface, or the surface on the ink inflow side, is irradiated with the laser beam. In this laser beam machining, the properties of the laser beam make each of through-holes or the nozzle holes tapered down or gradually narrowed in the direction of thickness of the plate material from the irradiated side, with the diameter of the nozzle hole gradually decreasing in the same direction to have an intended value at the open end on the ink jetting side, with a relatively high precision. Even when the diameters at the opposite open ends and the tapering shape of the nozzle hole are appropriately specified, however, it is difficult to obtain the nozzle holes of the shape precisely as designed. This is because of that in actual laser beam machining the laser beam can not be accurately focused at a point, and results in a rounded intersection of an inner circumferential surface of the nozzle hole and a plane surface of the nozzle plate on the irradiated side. That is, an edge of the open end of the nozzle hole on the ink inflow side is rounded. In addition, since it is difficult to position with high accuracy and precision the plate material to be the nozzle plate relative to the focal point of the laser beam, the degree of rounding or chamfering varies, in turn making it difficult to form the nozzle holes in a desired shape with high accuracy and precision.

The nozzle holes formed by the laser beam machining are subjected to a screening inspection whether the nozzle holes are good or bad. Conventionally, the open ends on the ink jetting side are strictly controlled or inspected since the shape of the open ends on this side significantly affects the ink ejection performance and the open ends on the opposite or ink inflow side are less strictly controlled.

To further improve the stability in ink ejection performance of the inkjet printhead, however, it is required to optimize the shape of the open ends at the ink inflow side also, in view of the minute variation in shape there with the above-mentioned rounding, in addition to the conventionally implemented controls including that on the ratio of the open areas.

SUMMARY OF THE INVENTION

The prevent invention has been developed in view of the above-described situations, and it is therefore an object of the invention to provide an inkjet printhead excellent in ink ejection performance.

To attain the object, the invention provides a droplet ejecting head including a nozzle plate through which are formed a plurality of nozzle holes each for ejecting a droplet therethrough, each of the nozzle holes comprising:

a jetting end which is open at a first one of opposite surfaces of the nozzle plate;

an inflow end which is open at a second surface of the nozzle plate;

a taper portion between the jetting end and a vicinity of the inflow end, at the taper portion a diameter of the nozzle hole linearly increasing from the jetting end to the vicinity of the inflow end so that the taper portion has a taper angle;

a connecting portion comprising a surface connecting an end of the taper portion and the inflow end, at the connecting portion the diameter increasing more greatly than at a surface which is obtained if the taper portion is extended at the taper angle; and where D1 and D2 respectively represent the diameter of the nozzle hole at the inflow end and at an imaginary inflow end which is obtained if there is not the connecting portion and the taper portion extends at the taper angle up to the second surface, D1 being larger than D2 but smaller than 1.2×D2.

According to this arrangement where the nozzle plate has the nozzle holes each having a shape satisfying a relationship between the diameter D1 of the inflow end and the diameter D2 of the imaginary flow end as follows:

D2<D1<1.2×D2, there is ensured a uniformity in flow of a liquid or the like to be ejected in the form of droplets, into the nozzle holes, and exhibits an excellent droplet ejection performance.

The droplet ejecting head thus constructed is suitably used as an inkjet printhead, for instance, but may be used for other purposes. For instance, the head may be used as the aforementioned circuit forming head or the 3D-body forming head.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 6 is a table showing a result of an experiment conducted on a relationship between the diameters of an actual and imaginary open ends of the nozzle hole and the speed at which an ink droplet is ejected from the nozzle hole.

DETAILED DESCRIPTION OF PREFERRED EMBODIMENTS

Hereinafter, there will be described one embodiment of the invention by referring to the accompanying drawings.

Figure 1:
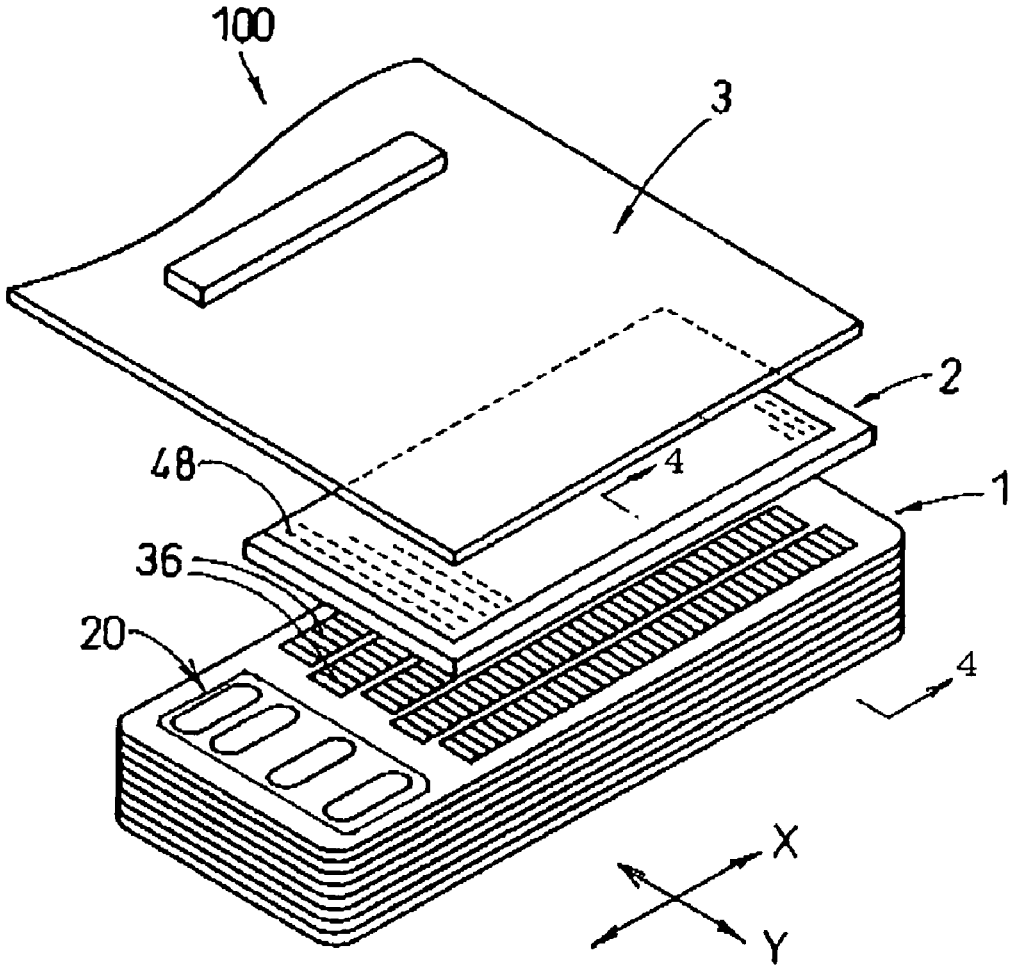
FIG. 1 is a perspective view of an inkjet printhead according to a first embodiment of the invention.

In FIG. 1, reference numeral 100 denotes a piezoelectric inkjet printhead 100 according to the embodiment of the invention. The printhead 100 includes a cavity unit 1 formed of a laminate of a plurality of metallic plates, and a planar piezoelectric actuator 2 attached to the cavity unit 1. A flexible flat cable 3 is superposed on and attached to an upper surface of the planar piezoelectric actuator 2, for connection with an external device. The lowermost one of the metallic plates of the cavity unit 1 is a nozzle plate 11 through which are formed a plurality of nozzle holes 4 to be open in an undersurface of the cavity unit 1. An ink droplet is ejected downward through each nozzle hole 4.

Figure 2:
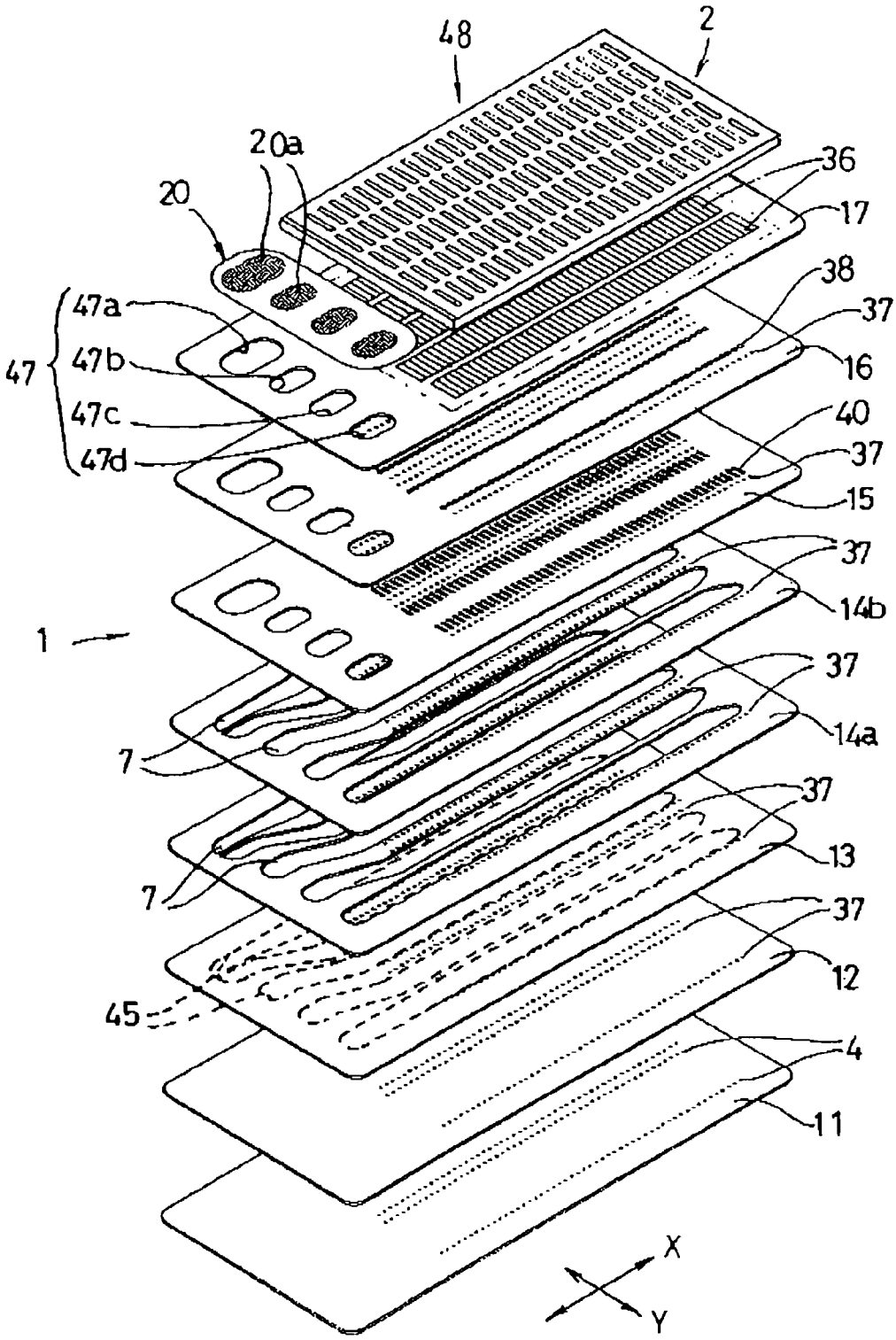
FIG. 2 is an exploded perspective view of the printhead.

As shown in FIG. 2, in addition to the nozzle plate 11 the cavity unit 1 further comprises a spacer plate 12, a damper plate 13, two manifold plates 14*a*, 14*b*, a supply plate 15, a base plate 16, and a cavity plate 17. These thin plates eight in total are stacked and attached to one another, that is, bonded with an adhesive into the laminate of the cavity unit 1.

In the present embodiment, each plate 11-17 has a thickness of about 50 to 150 μm. The nozzle plate 11 is made of a synthetic resin such as polyimide, and the other plates 12-17 are made of a steel sheet of 42% nickel alloy. A large number of the nozzle holes 4, which have a small diameter of about 20 to 23 μm, are formed through the nozzle plate 11 to be arranged at very small intervals, in five rows in a staggered fashion along a longitudinal direction of the nozzle plate 11 or an X-axis direction.

Figure 5:
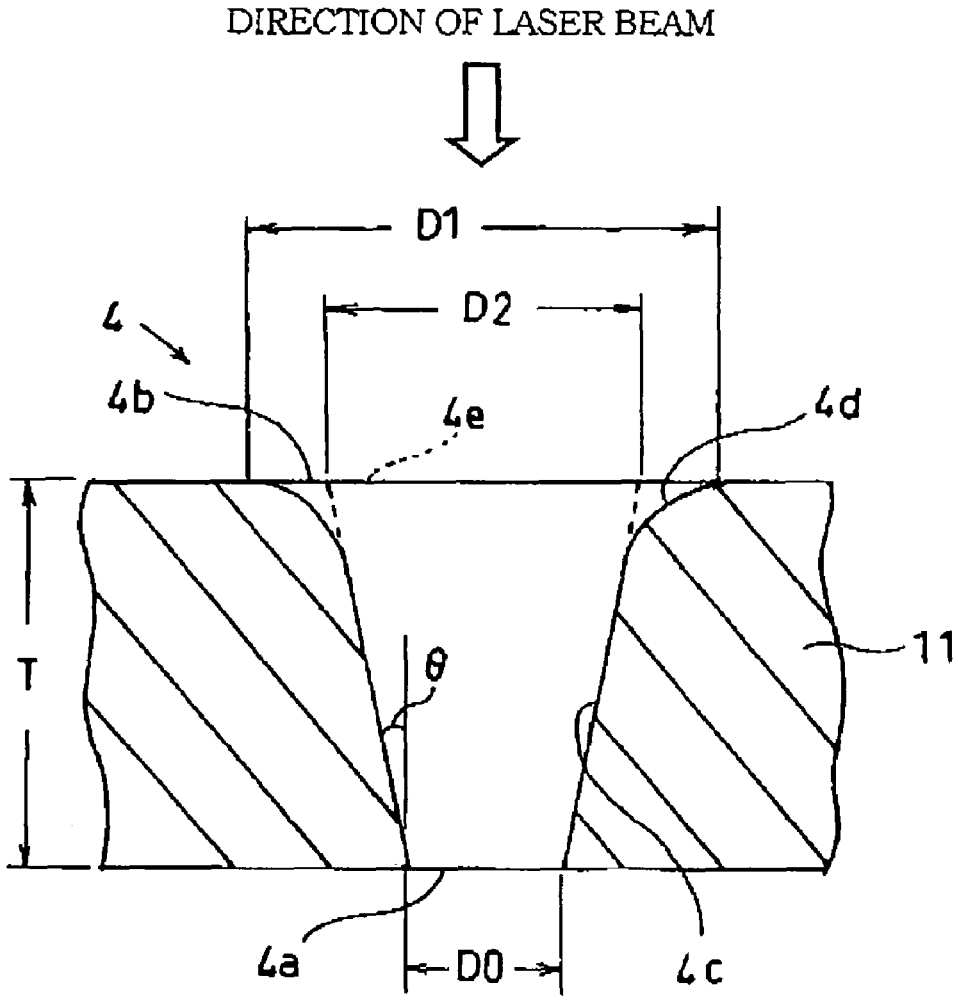
FIG. 5 is a schematic cross-sectional view of one of nozzle holes of the printhead.

As seen in FIG. 5, which is a schematic cross-sectional view of one of the nozzle holes 4, each nozzle hole 4 has an ink jetting end 4*a* open at a front surface of the nozzle plate 11 as a nozzle surface to be opposed to a recording medium, and an ink inflow end 4*b* open at a back surface of the nozzle plate 11 or its surface opposite to the nozzle surface. Each nozzle hole 4 tapers such that where diameters of the jetting end 4*a* and the inflow end 4*b* are represented by D0 and D1, respectively, D0<D1. The shape of the nozzle hole 4 will be fully described later.

Figure 3:
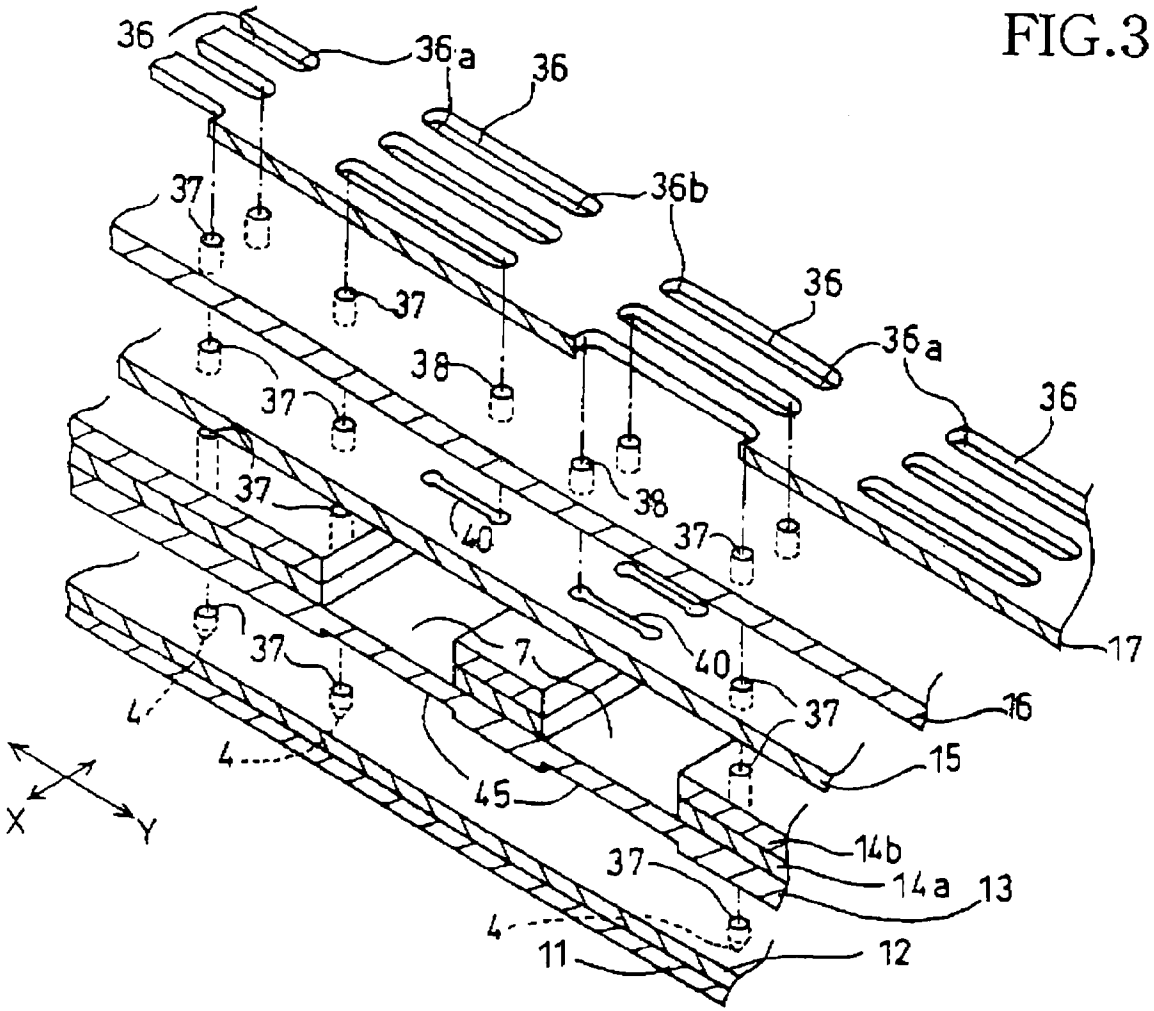
FIG. 3 is an exploded perspective view showing a cavity unit of the printhead in enlargement.

Referring to FIG. 3, the cavity plate 17 has a plurality of through-holes constituting pressure chambers 36, as arranged in five rows in a staggered fashion along the longitudinal direction of the cavity plate 17 or the X-axis direction. In the present embodiment, each of the pressure chambers 36 is elongate when seen from its upper side, with its longitudinal direction parallel to a direction of the shorter side of the cavity plate 17 or a Y-axis direction. One 36*a* of opposite longitudinal ends of the pressure chamber 36 is in communication with one of the nozzle holes 4, and the other longitudinal end 36*b* of the pressure chamber 36 is in communication with one of common ink chambers 7 as described later.

The longitudinal end 36*a* of the pressure chamber 36 is in communication with the nozzle hole 4 via minute communication holes 37 respectively formed through the supply plate 15, base plate 16, manifold plates 14*a*, 14*b*, damper plate 13, and spacer plate 12. That is, in each of these plates 12-16, a plurality of communication holes 37 are formed through the thickness of the plate 12-16 in a staggered arrangement.

In the base plate 16 bonded to an undersurface of the cavity plate 17 are formed a plurality of through-holes 38 each to be communicated with the longitudinal end 36*b* of a corresponding one of the pressure chambers 36.

In the supply plate 15 bonded to an undersurface of the base plate 16 are formed through-holes constituting connecting passages 40 for therethrough supplying ink from the common ink chambers 7 (described later) to the pressure chambers 36. Each connecting passage 40 has an inlet for introducing the ink from the common ink chamber 7, an outlet open toward the pressure chamber 36, that is, open to be connected to one of the above-mentioned through-holes 38, and an orifice extending between the inlet and outlet and having a smaller cross-sectional area to provide the largest resistance to the ink flow in the connecting passage 40.

Figure 4:
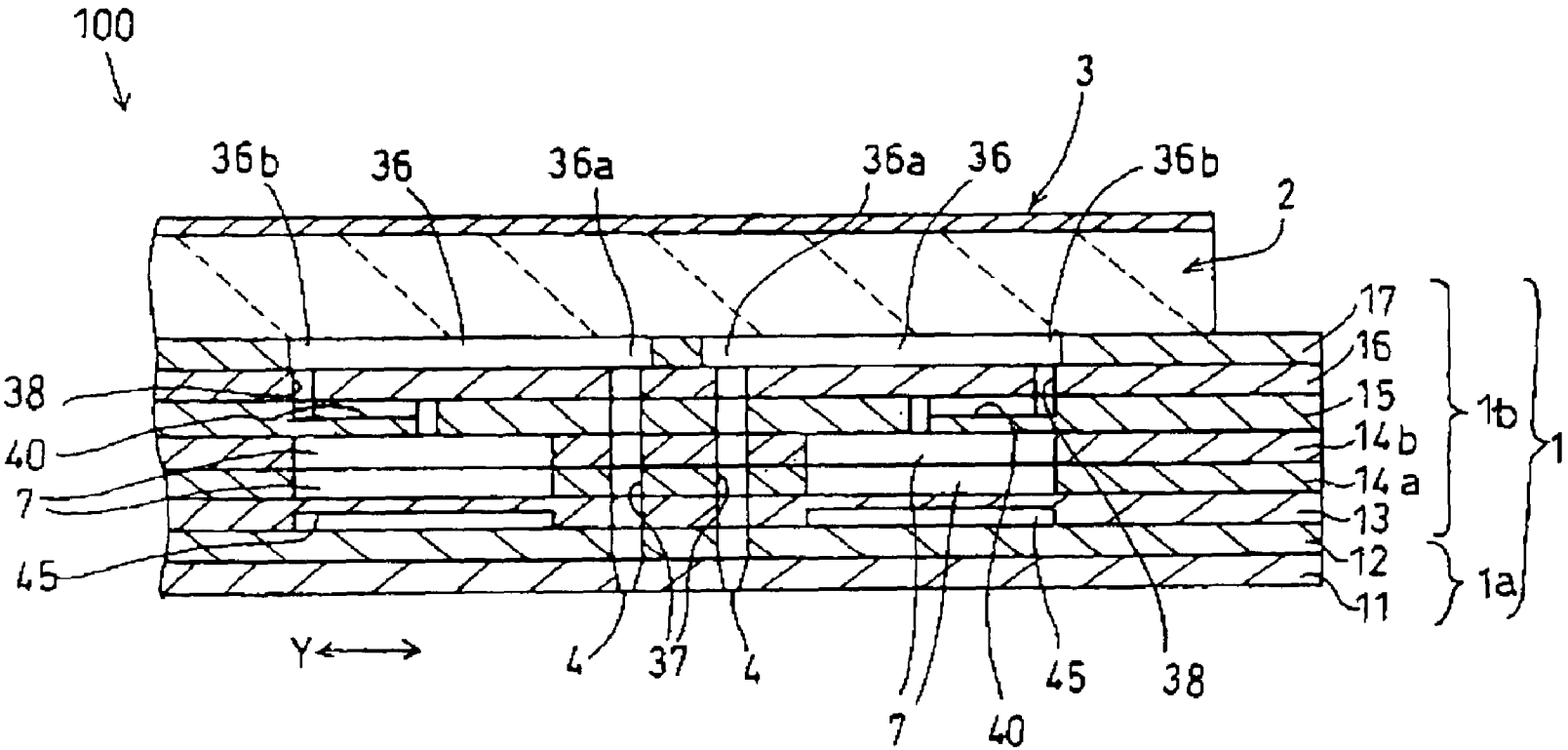
FIG. 4 is an enlarged cross-sectional view of the printhead taken along a line 4-4 in FIG. 1.

Each of the two manifold plates 14*a*, 14*b* has five elongate through-holes constituting the common ink chambers 7. More specifically, the elongate through-holes are formed through the thickness of the manifold plate 14*a*, 14*b* to extend along a longitudinal direction of the manifold plate 14*a*, 14*b* or the X-axis direction to positionally correspond to the rows of the nozzle holes 4. That is, as shown in FIGS. 2 and 4, the two manifold plates 14*a*, 14*b* are stacked to form a laminated body whose upper and lower surfaces are covered by the supply plate 15 and the damper plate 13, respectively, to form hermetically closed common ink chambers or manifold chambers 7 five in total. When seen in the stacking direction of the plates 11-17, each of the common ink chamber 7 extends in the direction of extension of each row of the pressure chambers 36 or nozzle holes 4 with a part of each of the pressure chambers 36 of a row overlapping the corresponding common ink chamber 7.

As shown in FIGS. 3 and 4, in an undersurface of the damper plate 13 bonded to an undersurface of the manifold plate 14*a* are formed recesses constituting damper chambers 45 not in communication with the common ink chambers 7. The position and shape, as seen from the upper side, of each damper chamber 45 are identical with those of the corresponding common ink chamber 7, as shown in FIG. 2. The damper plate 13 is a metal material capable of elastic deformation and thus a thin ceiling part over the damper chamber 45 is allowed to vibrate or displace in both the opposite directions, namely, toward the common ink chamber 7 and toward the damper chamber 45. When a change in pressure occurring in a pressure chamber 36 upon ejection of an ink droplet is propagated to the corresponding common ink chamber 7, the ceiling part is elastically deformed or vibrates to absorb and attenuate the pressure change. By this damping effect, the crosstalk, which is the propagation of the pressure change occurring in a pressure chamber 36 to another pressure chamber 36, is prevented.

As shown in FIG. 2, in a longitudinal end portion of each of the cavity plate 17, base plate 16, and supply plate 15 are formed four through-holes to constitute four ink supply ports 47 when these plates 15-17 are stacked, relatively positioned. Inks from an ink supply source are supplied into end portions of the common ink chambers 7 through the ink supply ports 47. The four ink supply ports 47 are denoted by reference numerals 47*a*, 47*b*, 47*c*, 47*d* from left to right as seen in FIG. 2.

The inks are supplied through ink passages extending from the ink supply ports 47 to the respective nozzle holes 4. More specifically, the inks introduced from the ink supply ports 47 are first supplied to the common ink chambers 7 as ink supply channels, and then distributed to the pressure chambers 36 via the connecting passages 40 formed in the supply plate 15 and the through-holes 38 in the base plate 16, as shown in FIG. 3. As described later, the ink in a pressure chamber 36 is pressurized by driving of the piezoelectric actuator 2 to be thereby supplied to the corresponding nozzle hole 4 through the communication holes 37.

As shown in FIG. 2, in the present embodiment four ink supply ports 47 and five common ink chambers 7 are provided. That is, the ink supply port 47*a* is connected to two common ink chambers 7, 7, and supplied with black ink which is more frequently used than the other color inks. To the other ink supply ports 47*b*, 47*c*, 47*d* are supplied inks of yellow, magenta, and cyan, respectively. As shown in FIG. 2, each of the ink supply ports 47*a*, 47*b*, 47*c*, 47*d* is covered by a filtering portion 20*a* of a filter member 20. The filter member 20 is bonded to the cavity plate 17 with an adhesive, for instance.

On the other hand, the piezoelectric actuator 2 is constructed as disclosed in Japanese Patent Application Laid-Open No 4-341853, for instance. That is, the actuator 2 is formed of a laminate of a plurality of piezoelectric sheets, although not shown, and each of the piezoelectric sheets has a thickness of about 30 μm. On an upper surface of each even-numbered sheet as counted from the bottom are formed narrow individual electrodes arranged in rows each extending in a longitudinal direction of the piezoelectric actuator 2 or the X-axis direction and at respective positions corresponding to the pressure chambers 36 in the cavity unit 1. On an upper surface of each odd-numbered piezoelectric sheet as counted from the bottom, there are formed common electrodes each of which is common to a plurality of the pressure chambers 36. On an upper surface of the topmost one of the piezoelectric sheets, there are formed surface electrodes 48 comprising individual surface electrodes 48 electrically connected to the respective individual electrodes, and common surface electrodes electrically connected to the common electrodes.

An adhesive sheet (not shown) made of a synthetic resin impervious to the inks is attached over an entirety of an undersurface (i.e., a major surface opposed to the pressure chambers 36) of the thus constructed planar piezoelectric actuator 2. Then, the piezoelectric actuator 2 is attached to the cavity unit 1 with its individual electrodes positioned to correspond to the pressure chambers 36 of the cavity unit 1. Thereafter, the flexible flat cable 3 shown in FIG. 4 is attached to an upper surface of the piezoelectric actuator 2 by being pressed thereto so that wiring (not shown) of the flexible flat cable 3 is electrically connected with the surface electrodes 48.

The inkjet printhead 100 as described above is manufactured as follows.

First, a sheet material which is to be the nozzle plate 11 and where the nozzle holes 4 are yet to be formed, is bonded to the spacer plate 12 in which the communication holes 37 are formed at positions corresponding to the nozzle holes 4. Then, the sheet material is irradiated with a laser beam, from the side of the spacer plate 12 and through the communication holes 37 to form the large number of nozzle holes 4, in a way as disclosed in Japanese Patent Application Laid-Open No. 11-147316 except that in the technique of the publication an entire surface of the spacer plate is irradiated with a laser beam. That is, in the present embodiment, the sheet material is irradiated with a laser beam in the form of spots, which are positioned using a lens and/or mask (not shown). In this way, a first subunit 1*a* as shown in FIG. 4 is prepared.

A diameter of the communication holes 37 is larger than twice that of the ink inflow end. For instance, the former is 120 μm and the latter is 40 to 50 μm. Where the diameter of the communication hole 37 is too small, making a difference in cross-sectional area between the communication hole 37 and the pressure chamber 36 too large, the pressure change in the pressure chamber 36 can not be well propagated, namely, the resistance of the ink passage to the ink flow is too large, leading to pressure loss. In addition, it is difficult to form a through-hole having a diameter smaller than the thickness of each plate 13-17 (which may be 100 to 150 μm) constituting a second subunit 1*b* shown in FIG. 4. The cross section of each communication hole 37 is sufficiently large in view of these facts.

On the other hand, the damper plate 13, manifold plates 14*a*, 14*b*, supply plate 15, base plate 16, and cavity plate 17, in each of which the through-holes and recesses are already formed, are stacked and bonded into an integral body to provide the second subunit 1*b* shown in FIG. 4. The second subunit 1*b* is superposed on and bonded to the first subunit 1*a*, to obtain the cavity unit 1 shown in FIG. 4.

Then, the cavity unit 1 is attached to the piezoelectric actuator 2, and the flexible flat cable 3 is attached to the actuator 2, to form the inkjet printhead 100.

The holes and recesses in the metallic plates 12-17, including the ink supply ports 47, the common ink chambers 7, the communication holes 37, the through-holes 38, the connecting passages 40, and the recesses constituting the damper chambers 45 may be formed by etching, electrical discharge machining, plasma machining, or laser beam machining, for instance. The filter member 20, which is formed of a single thin sheet of synthetic resin such as polyimide in a substantially rectangular shape as seen from the upper side, has the filtering portions 20*a* where minute openings are formed by laser beam machining or other methods. Where the filter member 20 is of metal, the filter member 20 may be formed by electroforming.

As described above, the nozzle holes 4 of the nozzle plate 11 are formed by laser beam machining. In forming the nozzle holes 4, a laser beam is aimed at predetermined positions on the back surface of the nozzle plate 11 or the surface on the ink inflow side, through the lens not shown. The irradiation with the laser beam is performed with various settings adjusted so as to make each nozzle hole 4 tapering at a taper angle θ with the diameter of the ink jetting end 4*a* being D0 while the nozzle plate 11 having a thickness T. The settings involved in the laser beam machining may be a duration of irradiation, designing of the lens with respect to the focal point thereof, and/or the diameter of openings of the mask if used, for instance. These settings are variable, however, depending upon the output power of the laser beam, and the thickness and material of the nozzle plate. A nominal diameter D2 of the ink inflow end, which is larger than D0, is obtained by extending the nozzle hole 4*a* from the ink jetting end 4*a* to the surface of the ink inflow end at the taper angle θ throughout, and expressed as follows: $D2=D0+2T\times\tan\theta$.

Since it is difficult to focus the laser beam at a desired point with high accuracy and precision and to position the nozzle plate 11 relatively to the focal point of the laser beam with high accuracy and precision, the edge at the ink inflow end on the side irradiated with the laser beam is rounded off, making the diameter there larger than the nominal value D2. Thus, the actual diameter of the ink inflow end 4*b* becomes D1 which is larger than D2. A taper portion 4*c* of the nozzle hole 4 where the hole expands from the ink jetting end 4*a* at the taper angle θ is formed to terminate at a vicinity of the ink inflow end 4*b*. The taper portion 4*c* and the ink inflow end 4*b* are connected via a curved surface or an edge portion 4*d* where the diameter increases more greatly than at the taper angle θ. Thus, even when the settings of the laser beam irradiation is adjusted so that the ink inflow end 4*b* has the nominal diameter D2, the diameter at the ink inflow end 4*b* of the actually formed nozzle hole 4 differs from D2. In other words, D2 represents a diameter of an imaginary ink inflow end 4*e*.

In the present embodiment, the edge portion comprises the curved surface convex toward an internal space of the nozzle hole, and the surface at the connection between the edge portion and each of the back surface of the nozzle plate and the surface of the taper portion is smooth. In order to obtain the effect of the invention, however, it is not essential that the surface of the edge portion be such.

The inventor conducted an experiment on how the difference between the actual and nominal diameters D1, D2 of the ink inflow end affects the ink ejection performance of the printhead 100. That is, an evaluation whether the ejection performance is "good" or "bad" was made, such that a plurality of nozzle plates 11 were prepared with the diameter of the ink inflow end of the nozzle hole different from plate to plate, and respectively incorporated in inkjet printheads 100, and it was determined for each nozzle plate whether the jet speed of the ink droplet was within an allowable range. The result of the experiment is shown in FIG. 6 in which O and X respectively indicate that the jet speed was within and out of the allowable range, that is, the ink ejection performance was good and bad. The thickness T of the nozzle plate 11 was 70 μm, and the nozzle hole was configured such that the taper angle θ was 9° and D0 was 25 μm, and accordingly the diameter D2 of the imaginary ink inflow end 4*e* was 47.2 μm, which is obtained based on the expression set forth above. The diameter D1 of the ink inflow end 4*b* of the nozzle hole 4 as indicated in a table of FIG. 6 represents a mean value of the measured diameters of a plurality of the ink inflow ends 4*b* in each nozzle plate.

Although basically it is preferable that the jet speed is high, an arrangement for improving the jet speed tends to accompany drawbacks such as instability related to formation of ink meniscus and occurrence of satellite droplets. Therefore, there is provided an upper limit in the jet speed.

As apparent from the table of FIG. 6, when D1 is smaller than 1.2 times D2, the jet speed of ink droplet falls within the allowable range and the ink ejection performance is good. Accordingly, by implementing a parts control to limit the diameter D1 of the ink inflow end 4*b* of the nozzle hole 4 within the range between D2 and 1.2 times D2, only nozzle plates 11 excellent in ink ejection performance can be selected. More specifically, upon completion of forming of the nozzle holes 4 in the nozzle plate 11 or first subunit 11*a*, the ink inflow ends 4*b* are inspected using the aforementioned criterion, in addition to inspection of the ink jetting ends 4*a*.

The diameters of the nozzle holes are measured using a CNC video measuring system, for instance. As the CNC video measuring system, NEXIV offered by Nikon Corporation may be employed.

By implementing the control in which the enlargement of the nozzle holes at their edge portion is inspected based on the criterion $D2<D1<1.2\times D2$, and only the nozzle plates with the nozzle holes having a diameter D1 within this range are selected to be used, even when the shape of the nozzle hole tends to vary with the edge portion inevitably formed upon formation of the taper portion, only good nozzle plates are easily selected for use.

According to the present embodiments as described above, the enlargement at the ink inflow end 4*b* is strictly regulated taking account of the formation of the edge portion 4*d*, so as to uniform the ink flow into the nozzle holes in the nozzle plate. Thus, the stability in ink ejection performance of the inkjet printhead can be enhanced.

Further, since the nozzle holes are formed by irradiating the surface of the nozzle plate on the ink inflow side with a laser beam, each formed nozzle hole has the taper portion expanding from the ink jetting end to the ink inflow end at a taper angle. In this way, the taper portion where the diameter gradually decreases from the ink inflow end to the ink jetting end can be easily formed.

What is claimed is:

1. A droplet ejecting head including a nozzle plate through which are formed a plurality of nozzle holes each for ejecting a droplet therethrough, each of the nozzle holes comprising:

a jetting end which is open at a first one of opposite surfaces of the nozzle plate;

an inflow end which is open at a second surface of the nozzle plate;

a taper portion between the jetting end and a vicinity of the inflow end, at the taper portion a diameter of the nozzle hole linearly increasing from the jetting end to the vicinity of the inflow end so that the taper portion has a taper angle;

a connecting portion comprising a surface connecting an end of the taper portion and the inflow end, at the connecting portion the diameter increasing more greatly than at a surface which is obtained if the taper portion is extended at the taper angle; and where D1 and D2 respectively represent the diameter of the nozzle hole at the inflow end and at an imaginary inflow end which is obtained if there is not the connecting portion and the taper portion extends at the taper angle up to the second surface, D1 being larger than D2 but smaller than 1.2×D2.

2. The droplet ejecting head according to claim 1, wherein the droplet is a droplet of ink, the jetting end is an ink jetting end, the inflow end is an ink inflow end, and thus the droplet ejecting head serves as an inkjet printhead which ejects the ink droplet onto a recording medium.

3. The droplet ejecting head according to claim 2, wherein the surface of the connecting portion is convex toward an internal space of the nozzle hole.

4. The droplet ejecting head according to claim 2, wherein the nozzle holes are formed by irradiating the second surface of the nozzle plate with a laser beam.

5. The droplet ejecting head according to claim 3, wherein the connecting portion is formed concurrently with the formation of the taper portion with the laser beam.

6. The droplet ejecting head according to claim 2, wherein a surface of the taper portion and the surface of the connecting portion are smoothly connected.

7. The droplet ejecting head according to claim 2, wherein the second surface of the nozzle plate and the surface of the connecting portion are smoothly connected.

8. The droplet ejecting head according to claim 2, wherein the head further comprises another plate attached to the second surface of the nozzle plate, and having a plurality of communication holes respectively positionally corresponding to the nozzle holes, a diameter D3 of each of the communication holes being larger than D1.

9. The droplet ejecting head according to claim 2, wherein the head further comprises another plate attached to the second surface of the nozzle plate, and having a plurality of communication holes respectively positionally corresponding to the nozzle holes, a diameter D3 of each of the communication holes being larger than twice D1.

* * * * *